US008632017B2

(12) United States Patent
Kucera et al.

(10) Patent No.: US 8,632,017 B2
(45) **Date of Patent: *Jan. 21, 2014**

(54) DAMPER CONTROL SYSTEM

(71) Applicant: Honeywell International Inc., Morristown, NJ (US)

(72) Inventors: David Kucera, Morristown, NJ (US); Shanna L. Leeland, Duvall, WA (US); Peter M. Anderson, St. Paul, MN (US)

(73) Assignee: Honeywell International Inc., Morristown, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/662,089

(22) Filed: Oct. 26, 2012

(65) Prior Publication Data

US 2013/0048743 A1 Feb. 28, 2013

Related U.S. Application Data

(63) Continuation of application No. 12/553,795, filed on Sep. 3, 2009, now Pat. No. 8,297,524.

(51) Int. Cl.
*F23L 13/02* (2006.01)
*F23N 3/00* (2006.01)

(52) U.S. Cl.
USPC ..... 236/1 G; 431/20; 700/302

(58) Field of Classification Search
USPC ..... 236/1 G, 15 BD, 26 A; 431/20; 126/285 R; 700/302
See application file for complete search history.

(56) References Cited

U.S. PATENT DOCUMENTS

| | | | |
|---|---|---|---|
| 3,708,737 | A | 1/1973 | Johnson |
| 3,818,297 | A | 6/1974 | Ha et al. |
| 3,847,350 | A | 11/1974 | Thompson |
| 3,849,350 | A | 11/1974 | Matsko |
| 4,204,833 | A | 5/1980 | Kmetz et al. |
| 4,256,257 | A | 3/1981 | Pinkerton |
| 4,267,965 | A | 5/1981 | Everett |
| 4,299,554 | A | 11/1981 | Williams |
| 4,324,944 | A | 4/1982 | Weihrich et al. |
| RE30,936 | E | 5/1982 | Kmetz et al. |

(Continued)

FOREIGN PATENT DOCUMENTS

| | | |
|---|---|---|
| EP | 0356609 | 3/1990 |
| GB | 2211331 | 6/1989 |

OTHER PUBLICATIONS

Honeywell D896 Automatic Vent Damper, Product Data, 12 pages, 1997.

(Continued)

*Primary Examiner* — Marc Norman
(74) *Attorney, Agent, or Firm* — Seager Tufte & Wickhem LLC.

(57) ABSTRACT

A damper control system having energy efficient mechanisms. The system may use a heat-to-electric power converter such as a thermopile. Heat may come from a pilot light used for igniting a flame for an appliance. The system may store electric energy in a storage module which could be a sufficiently large capacitor. The system may monitor the position of a damper in a vent or the like and provide start and stop movements of the damper using minimal energy. One way that the system may control electrical energy to a damper motor or another electrical mover of the damper is to use pulse width modulated signals.

23 Claims, 8 Drawing Sheets

(56) References Cited

U.S. PATENT DOCUMENTS

| | | | |
|---|---|---|---|
| 4,333,002 | A | 6/1982 | Kozak |
| 4,390,123 | A | 6/1983 | McCabe |
| 4,460,329 | A | 7/1984 | Trent |
| 4,508,261 | A | 4/1985 | Blank |
| 4,511,790 | A | 4/1985 | Kozak |
| 4,538,980 | A | 9/1985 | Hoyme |
| 4,588,875 | A | 5/1986 | Kozak et al. |
| 4,692,598 | A | 9/1987 | Yoshida et al. |
| 4,696,639 | A | 9/1987 | Bohan, Jr. |
| 4,734,658 | A | 3/1988 | Bohan, Jr. |
| 4,742,210 | A | 5/1988 | Tsuchiyama et al. |
| 4,752,210 | A | 6/1988 | Trent |
| 4,770,629 | A | 9/1988 | Bohan, Jr. |
| 4,778,378 | A | 10/1988 | Dolnick et al. |
| 4,834,284 | A | 5/1989 | Vandermeyden |
| 4,835,670 | A | 5/1989 | Adams et al. |
| 4,880,376 | A | 11/1989 | Bartels et al. |
| 4,984,981 | A | 1/1991 | Pottebaum |
| 4,986,468 | A | 1/1991 | Deisinger |
| 5,007,156 | A | 4/1991 | Hurtgen |
| 5,039,006 | A | 8/1991 | Habegger |
| 5,276,630 | A | 1/1994 | Baldwin et al. |
| 5,442,157 | A | 8/1995 | Jackson |
| 5,612,629 | A | 3/1997 | Mullin et al. |
| 5,622,200 | A | 4/1997 | Schulze |
| 5,652,525 | A | 7/1997 | Mullin et al. |
| 5,660,328 | A | 8/1997 | Momber |
| 5,797,358 | A | 8/1998 | Brandt et al. |
| 5,896,089 | A | 4/1999 | Bowles |
| 5,968,393 | A | 10/1999 | Demaline |
| 5,975,884 | A | 11/1999 | Dugger |
| 6,048,193 | A | 4/2000 | Juntunen et al. |
| 6,053,130 | A | 4/2000 | Shellenberger |
| 6,059,195 | A | 5/2000 | Adams et al. |
| 6,208,806 | B1 | 3/2001 | Langford |
| 6,257,871 | B1 | 7/2001 | Weiss et al. |
| 6,261,087 | B1 | 7/2001 | Bird et al. |
| 6,271,505 | B1 | 8/2001 | Henderson |
| 6,293,471 | B1 | 9/2001 | Stettin et al. |
| 6,350,967 | B1 | 2/2002 | Scott |
| RE37,745 | E | 6/2002 | Brandt et al. |
| 6,560,409 | B2 | 5/2003 | Troost, IV |
| 6,584,197 | B1 * | 6/2003 | Boudreaux et al. ..... 379/413.02 |
| 6,644,957 | B2 | 11/2003 | Weiss |
| 6,684,821 | B2 | 2/2004 | Lannes et al. |
| 6,701,874 | B1 | 3/2004 | Schultz et al. |
| 6,838,847 | B2 | 1/2005 | Dragoi et al. |
| 6,880,493 | B2 | 4/2005 | Clifford |
| 6,934,862 | B2 | 8/2005 | Sharood et al. |
| 6,955,301 | B2 | 10/2005 | Munsterhuis et al. |
| 6,959,876 | B2 | 11/2005 | Chian et al. |
| 7,205,737 | B1 | 4/2007 | Bilodeau |
| 7,205,892 | B2 | 4/2007 | Luebke et al. |
| 7,221,862 | B1 | 5/2007 | Miller et al. |
| 7,252,502 | B2 | 8/2007 | Munsterhuis |
| 7,275,533 | B2 | 10/2007 | Soeholm et al. |
| 7,317,265 | B2 | 1/2008 | Chian et al. |
| 7,712,677 | B1 | 5/2010 | Munsterhuis et al. |
| 7,721,972 | B2 | 5/2010 | Bracken et al. |
| 7,747,358 | B2 | 6/2010 | Troost et al. |
| 7,804,047 | B2 | 9/2010 | Zak et al. |
| 8,113,823 | B2 | 2/2012 | Guzorek |
| 8,297,524 | B2 | 10/2012 | Kucera et al. |
| 2005/0161518 | A1 * | 7/2005 | Munsterhuis ..... 236/26 A |
| 2005/0247304 | A1 | 11/2005 | Weiss |
| 2006/0214015 | A1 | 9/2006 | Furukawa et al. |
| 2007/0023333 | A1 | 2/2007 | Mouhebaty et al. |
| 2010/0173252 | A1 | 7/2010 | Bracken et al. |
| 2011/0048340 | A1 | 3/2011 | Anderson et al. |
| 2011/0270544 | A1 | 11/2011 | Kucera et al. |

OTHER PUBLICATIONS

Honeywell S8610U Universal Intermittent Pilot Module, Installation Instructions, 20 pages, Aug. 1996.

Johnson Controls Q135 Automatic Flue Damper System, 8 pages, 1998.

Lennox, "Network Control Panel (NCP), User's Manual," 18 pages, Nov. 1999.

Weil-McLain, Technical Services Bulletin No. SB201, 2 pages, Nov. 20, 2002.

* cited by examiner

DAMPER CONTROL SYSTEM

This present application is a Continuation of U.S. patent application Ser. No. 12/553,795, filed Sep. 3, 2009, and entitled "A Damper Control System". U.S. patent application Ser. No. 12/553,795, filed Sep. 3, 2009, is hereby incorporated by reference.

BACKGROUND

The present invention pertains to devices for building control systems and particularly damper control devices.

SUMMARY

The present invention is a damper control system having energy efficient mechanisms. The invention may use a heat-to-electric power converter such as a thermopile. The invention may store the electric energy in a significantly large capacitor or other electrical storage device. The invention may monitor the position of a damper in a vent or the like and provide start and stop movements of the damper using minimal energy. One among several ways of controlling electrical energy to a damper motor or other electrical mover is to use variable pulse width modulated signals.

DESCRIPTION

Figure 1:
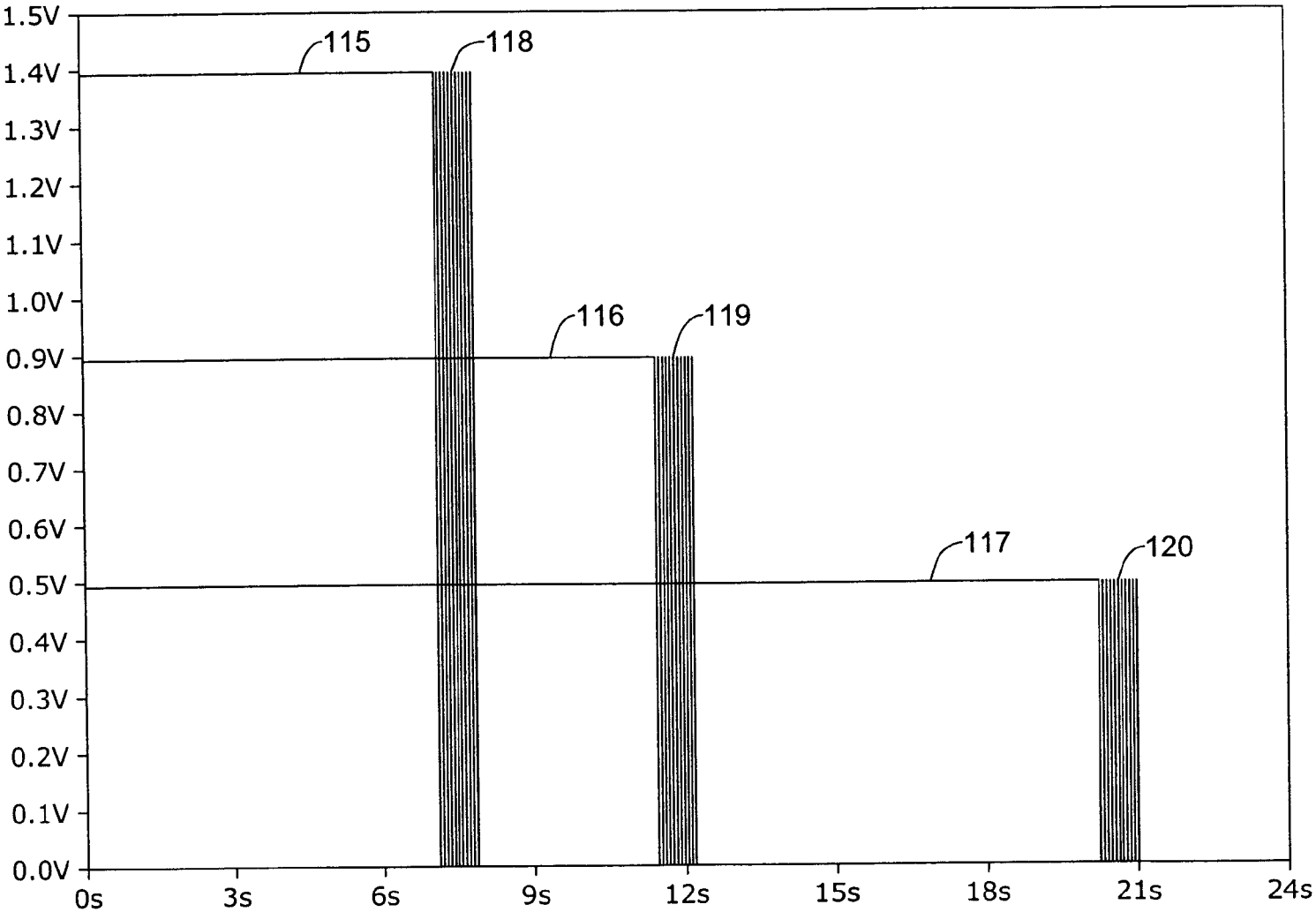
FIG. 1 is a graph of a damper drive at various voltages.

Various guidelines and energy efficiency ratings are effectively forcing water heater manufacturers to look at new ways to eliminate standby losses. Using a flame-powered control system in combination with a flue damper on a water heater is an important step in meeting such guidelines and ratings. However, a flame-powered damper motor control may suffer from the fact that the flame-generated supply voltage varies over a wider range. Too low of a voltage may not guarantee proper damper rotation while too large of a voltage may cause the damper to move past the desired position and continue to rotate the damper to the wrong position. To overcome this, a system may implement at least two thermopile devices in combination with a resistor parallel to the motor which consumes much power.

Also, a system may use end switches that are in series with the motor and act to remove current from the motor at a desired position. This arrangement may further increase the risk of moving the damper past the desired position—if the switches turn on again when the damper overshoots the desired position, the motor may be energized again and drive the damper to the wrong position. These non-ideal solutions appear in place since no flame-powered components which can regulate the motor supply voltage seem to be commercially available.

The present system may solve the problem of the damper moving past the desired position and supply voltage regulation. The system may have application to fossil fuel burning appliances such as a water heater. The system may have the following features. The system may use flame-powered control electronics that are capable of controlling a damper motor supply voltage level. The control electronics may use just one thermopile (for cost reduction) in combination with a storage capacitor having a large capacitance, or other storage device such as a battery or the like, to provide motor supply voltage when needed. An example of a large capacitor rating may be about one farad, although the rating may be significant from a fraction of a farad to several farads, depending on a load that a moving damper presents electrically to the capacitor or equivalent storage device. The capacitor needs to be significant enough to provide power sufficient to drive the damper in accordance with the present system. However, if the power from the storage device is too low, then the driving of the damper may be stopped; for instance, that stopping would be equivalent to a PWM signal having a duty cycle equal to zero. In the meanwhile, the storage capacitor may be recharged. The capacitor or other storage device may be recharged via power management implemented in the control electronics.

A resistor parallel to the damper motor may be eliminated thus significantly reducing the amount of power needed to operate the damper, and enabling the use of just one thermopile combined with a large capacitor or other storage device. The thermopile or other heat-to-electric power converter may be positioned near a normal pilot light or flame used for igniting a flame for an appliance. The thermopile or other heat-to-electric power converter may instead be positioned near much smaller than normal pilot flame or light. Such structure may result in lower costs compared to a system using several thermopiles, a normal pilot flame or a heating flame. In lieu of a thermopile or other heat-to-electric power converter, a solar cell and a source of light may be used as a source of power. These sources and/or other power sources may be used in a combination.

With the present system, moving past the desired position may be avoided by controlling the motor power supply voltage as the damper approaches the desired position. One way of control may be a use of variable pulse-width modulation (PWM), such as reducing the duty cycle to slow it down or vice versa. Another way of control would be to have a transistor connected in series which could be controlled to limit the current to the motor driving the damper to slow it down, stop it, start it or speed it up. Moving past the desired position may be further reduced or avoided by connecting an end switch or switches in the damper assembly such that the switch or switches are not in series with the motor power supply. End switches may provide information about the damper position. The end switch or switches may maintain contact over a range of angles between a desired open or closed damper position. This is to ensure that the control electronics can detect when the desired position is being approached, and operate to control the motor supply voltage or current in order to decelerate the rotation such that the damper reaches and stops at the desired position. An approaching position may be detected with a timer which indicates the time for the damper to reach a certain position. If the time is deemed too short or too long as indicated by the time the damper reaches the desired position according to the switch or switches, then the timer may be re-adjusted (e.g., via feedback) to more accurately indicate the time of the desired position at the next event of damper movement. Such adjustment may be continuous. The timer may instead be regarded as a time period or limit.

The voltage supply may be connected/disconnected, or adjusted, by a switching device (e.g., transistor) in the control electronics. Since application safety is taken care of by the control electronics, a redundant end switch in the damper assembly may be eliminated, further reducing costs. In existing systems, the redundant end switch is connected in series with another end switch and the gas main valve and is implemented to make the system robust to single failures.

Figure 3:
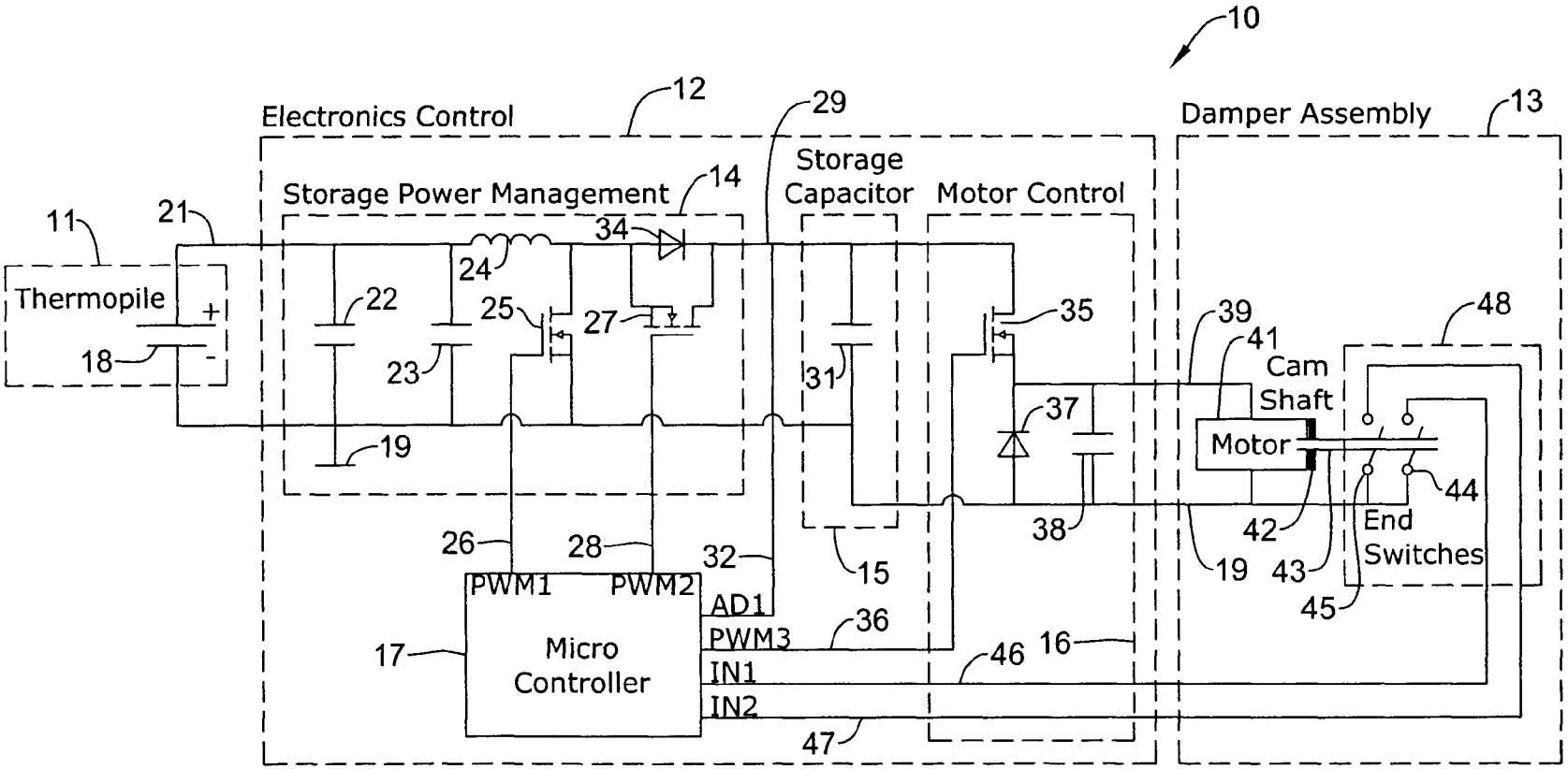
FIG. 3 and FIG. 4 provide circuit details of the components of the damper control system shown in FIG. 2.
Figure 4:
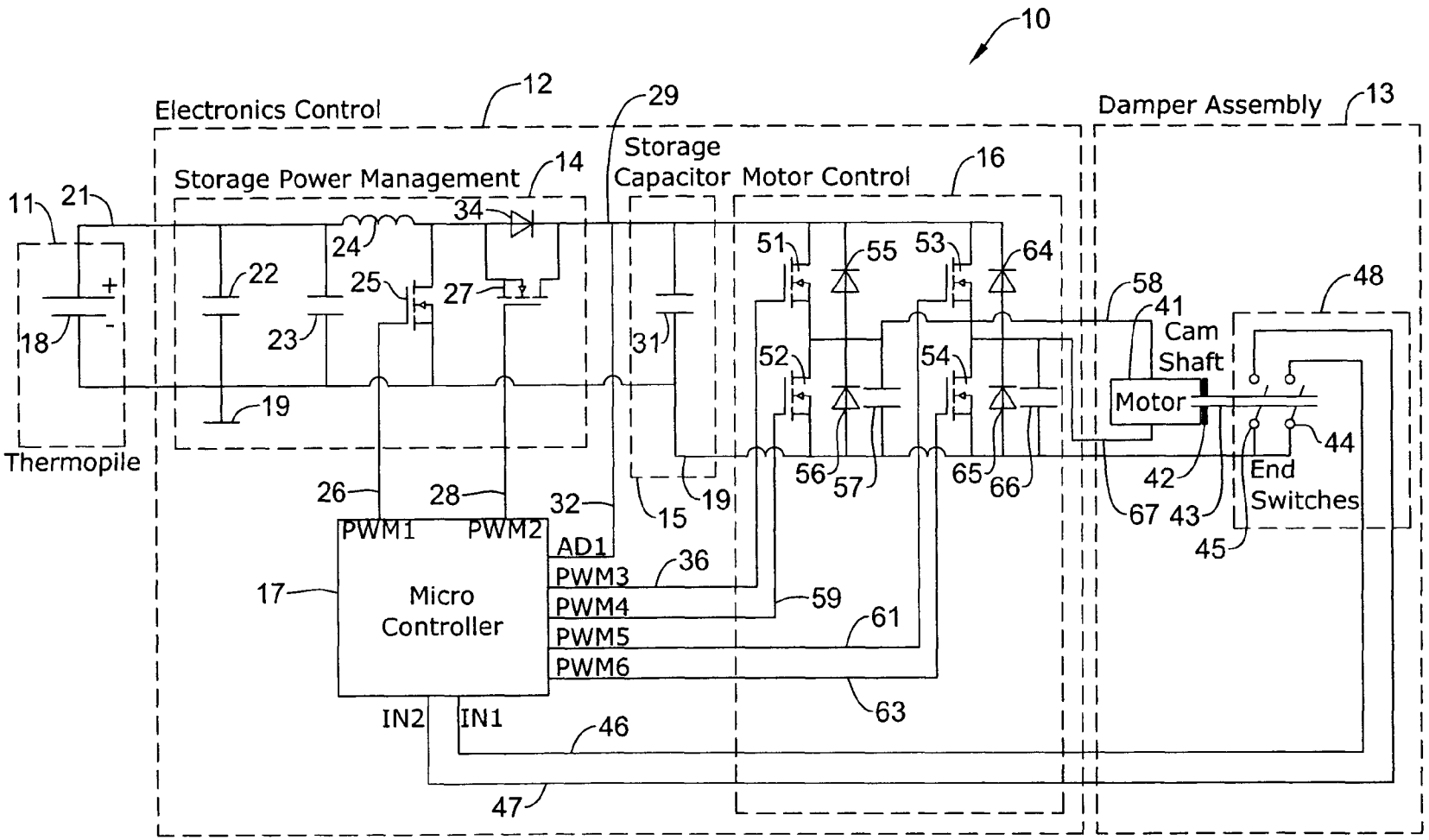
Figure 4A:
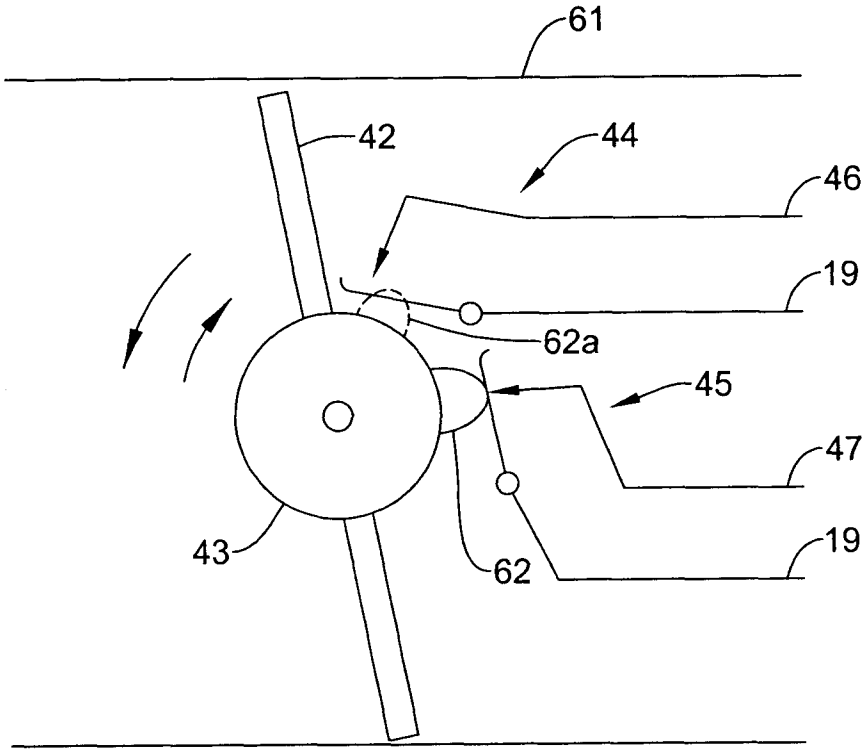
FIG. 4*a* is a diagram of damper in a vent including a camshaft with position switches.

A sensor for indicating a position of the damper may be used in lieu of the switch or switches, e.g., switches 44 and 45 in FIGS. 3, 4 and 4*a*. A potentiometer, Hall sensor, light source and detector, and/or other devices may be used as a position indicator for a damper.

In addition, the control electronics may be capable of sensing water temperature and controlling gas valves. This may eliminate the need in some systems in that the temperature sensor has to provide a pair of contacts. Instead, a combination of a low cost accurate sensor (e.g., NTC sensor), an electronically sensed temperature set point, and a safety algorithm implemented in the control electronics, may provide accuracy and safety greater than other systems. Although some of these items might not relate directly to damper control, they may constitute an important improvement over other systems.

The present system may have control electronics which are flame-powered and include a microprocessor capable of managing power, reading a state of the damper end switches, and controlling electronic switches that connect power to the damper motor. The system may be powered by means of a single thermopile. When flame power is available, a large storage device may be charged. This device may then provide power for the damper at the end of heat cycle to drive it closed, preserve the remaining charge during standby (flame off), and again provide power to the damper at the beginning of the next heat cycle to drive it open. At the very first manual system start-up, a pilot flame may be used to charge the storage device via the power converter, for example in a case with the damper closed, prior to an opening the damper and igniting the main flame. The main flame and/or the pilot light, having a medium or small size, may be used as a source of heat for a heat-to-electric power converter. For other examples, a solar cell or other kind of light-to-electric power converter may be used along with a source of light such as ambient light, a bulb, or a flame. These different kinds of power sources may be used separately or in combination. The control electronics or controller may have inputs which include the energy storage module status, damper position signals, an appliance request for heat, and other signals useful for operation of the damper control system.

The present damper assembly may appear similar to other assemblies; however, the present assembly may have significant differences in that it has no parallel resistor, the end switches are not in series with the motor supply, and the redundant end switch is not present.

The damper may be driven with unregulated DC voltage. The higher the voltage, the faster the motor spins. If the supply voltage is too low, the motor will not be driven (or will stop being driven) until the voltage is increased above a specified level. For a given voltage, using adjustable pulse width modulation, the motor and driven damper may be slowed by reducing the duty cycle or increased in speed by enlarging the duty cycle.

When the damper is approaching the open or closed positions, voltage regulation to the motor may begin in order to control the speed and allow the motor to slowly coast the damper into place or destined position. FIG. 1 is a graph of a damper drive at various voltages. The graph shows the motor drive for three different supply voltages, 1.4V, 0.9V, and 0.5V at levels 115, 116 and 117, respectively. Since the higher voltage drive will get to the end position faster, the PWM begins sooner. In the present example, the coasting voltage may be set to 0.3V for each of the supply voltages; so that the 1.4V supply PWM 118 is at 21%, the 0.9V supply PMW 119 is at 33%, and the 0.5V supply PMW 120 is at 60%. One may note that FIG. 1 is for illustrative purposes in that the specific voltages and timing parameters used are just examples.

A damper approaching an end position may be detected by a switch (in addition to the end switch) placed before the end position or by a shaped switch-actuating cam such that the switch remains actuated over a specified range of damper rotation. The end position may additionally be determined by timing the duration of rotation. Based on previous operations, the time to reach the end position may be estimated and the PWM can start at a pre-determined time.

Another way to stop the motor and damper at the correct position may include an attempt to stop the motor the instant the end switch is closed. If the switch opens again, it may be assumed that the motor spun past the desired stop point and that the damper control can reverse motor rotation by changing the drive voltage (for example, by reversing the voltage polarity to a DC motor or reversing the step direction to a stepper motor). If the damper control is incapable of reversing or does not reverse the damper motor, then the motor may drive the damper nearly all the way around again in the same direction so as to arrive close to the desired stop point. The motor for moving the damper may be instead an electric solenoid or other electric mover.

Figure 2:
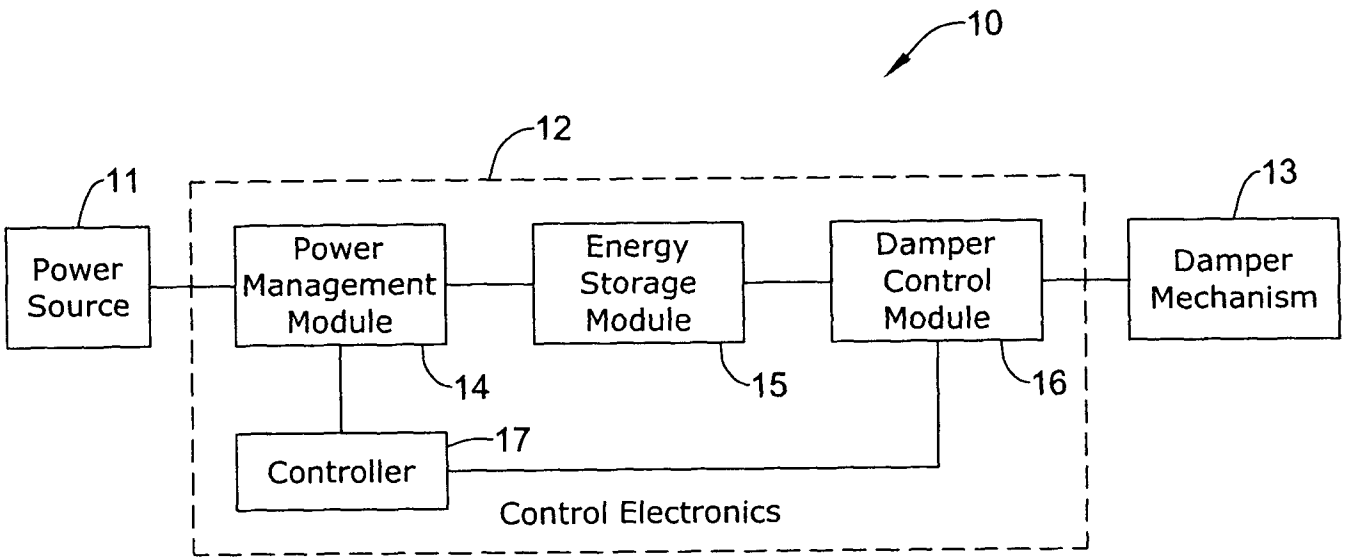
FIG. 2 is a diagram showing basic components of a damper control system.

FIG. 2 is a diagram showing basic components of a damper control system 10. A source 11 may provide power to components of control electronics 12. An output of electronics 12 may be connected to a damper assembly 13 to control a position of a damper. Control electronics 12 has a power management module 14 having an input connected to the power source 11 and an output connected to an input of an energy storage module 15. Electronics 12 may also have a damper control module 16 with an input connected to the energy storage module 15 and an output connected to the damper assembly 13. There may also be a controller 17 connected to the power management module 14 and the damper control module 16.

FIG. 3 and FIG. 4 provide circuit details of the components of damper control system 10 shown in FIG. 2. System 10 of FIG. 3 has a single direction drive for the damper control module 16. FIG. 4 has a reversible direction drive for module 16. The damper control module 16 may also be referred to as a motor control or motor control drive.

Power source 11 may have a thermopile 18 which converts thermal energy into electrical energy. The negative terminal of the thermopile 18 may be connected to a reference voltage or ground terminal 19 of system 10. The power management module 14 may have a capacitor 22 with one terminal connected to terminal 19 and another terminal connected to the positive terminal 21 of thermopile 18. Capacitor 22 may have a value of about 220 microfarads. Another capacitor 23 may be connected in parallel with capacitor 22. Capacitor 23 may have a value of about 100 nanofarads. An inductor 24 may have one end connected to terminal 21 and the other end connected to a drain of a field effect transistor (FET) 25. Inductor 24 may have a value of about 220 microhenries. FET 25 may have a source connected to terminal 19 and a gate connected to a PWM1 output 26 of controller 17. A source of a FET 27 may be connected to the drain of FET 25. A gate of FET 27 may be connected to a PWM2 output 28 of controller 17.

A drain of FET 27 may be connected to a terminal 29 which is connected to one end of a capacitor 31 of the energy storage module 15. The other end of capacitor 31 may be connected to reference terminal 19. Terminal 29 may also be connected to an AD1 input 32 of controller 17. A Schottky diode 34 may have an anode connected to the source of FET 27 and have a cathode connected to the drain of FET 27. Diode 34 may have a model number MBR0530TX. FET's 25 and 27 may have a model number MGSF2N02ELT1.

Capacitor 31 of energy storage module 15 may be used for storing energy for system 10. The value of capacitor 31 may be about one farad. Terminal 29 from capacitor 31 may be connected to an input of damper control module 16, which may be regarded as a motor control. The input of module 16 may be a drain of a FET 35. A gate of FET 35 may be connected to a PWM3 output 36 of controller 17. A source of FET 35 may be connected to a cathode of a diode 37. An anode of diode 37 may be connected to reference terminal 19. A capacitor 38 may be connected in parallel with diode 37. Diode 37 may have a model number S1G. Capacitor 38 may have a value of about 100 nanofarads. FET 35 may have the same model number as FET 27. FET 35, diode 37 and capacitor 38 may constitute the damper control module 16 having a single direction drive motor control for damper assembly 13.

The output of module 16 at terminals 19 and 39 may go to a motor 41 of damper assembly 13. Motor 41 may drive a damper 42 having a camshaft 43. End switches 44 and 45 may be situated proximate to the camshaft 43 such that one switch 44 operates when the camshaft 43 is in one position and the other switch 45 operates when the camshaft 43 is in another position. The operation of switches 44 and 45 relative to camshaft 43 is to indicate to the controller 17 a position of the damper 42 as it is moved by motor 41. Switch 44 has one terminal connected to reference terminal 19 and the other terminal connected to an IN1 input 46 of controller 17. Switch 45 may have one terminal connected to reference terminal 19 and the other terminal connected to an IN2 input 47 of controller 17. The end switches 44 and 45 may be regarded as a switch mechanism 48. Devices, other than a switch or switches, may be used for damper position detection. Controller 17 may be a microcontroller of one kind or another.

Damper control system 10 in FIG. 4 is similar to system 10 in FIG. 3 except for damper control module 16 for motor control is different. Terminal 29 may be connected from capacitor 31 to a drain of a FET 51. Reference terminal 19 may be connected from capacitor 31 to a source of a FET 52. A gate of FET 51 may be connected to the PWM3 output 36 of controller 17. A source of FET 51 may be connected to a drain of a FET 52, an anode of a diode 55, a cathode of a diode 56, a first end of a capacitor 57 and terminal 58 to motor 41. A gate of FET 52 may be connected to a PWM4 output 59 of controller 17. A gate of FET 53 may be connected to a PWM5 output of controller 17. A gate of FET 54 may be connected to a PWM6 output of controller 17. Terminal 29 may be also connected to a cathode of diode 55, a drain of FET 53 and a cathode of a diode 64. An anode of diode 56, a second end of capacitor 57, a source of transistor 54, an anode of diode 65, and a second end of a capacitor 66 may be connected to terminal 19. A source of FET 53, a drain of FET 54, an anode of diode 64 and a first end of capacitor 66 may be connected to a terminal 67 to motor 41. FET's 51, 52, 53 and 54 may have a model number MGSF2N02ELT1. Diodes 55, 56, 64 and 65 may have a model number S1G. Capacitors 57 and 66 have a value of about 100 nanofarads. Damper assembly 13 of FIG. 4 may be like damper assembly 13 of FIG. 3. Power source 11 may contain a thermopile 18 in FIG. 4. Power management module 14 of system 10 in FIG. 4 may be like module 14 of system 10 in FIG. 3.

FIG. 4*a* is a diagram of damper 42 for a vent 61. The damper may have camshaft 43 attached for indicating the position of the damper. In this instance, as driven by motor 41 (not shown in FIG. 4*a*) attached to shaft 43, the damper may rotate counterclockwise to open and clockwise to close. Switch 45 may close due to a cam lobe on the camshaft when damper 42 approaches closure in a clockwise movement. Switch 46 may close when the damper moves in a counterclockwise direction into an open position as indicated by a new position 62*a* of cam lobe 62. Switch 45 may open upon a movement of lobe 62 away from the switch. This is merely one arrangement of position indication of the damper, particularly with one or more switches.

Figure 5:
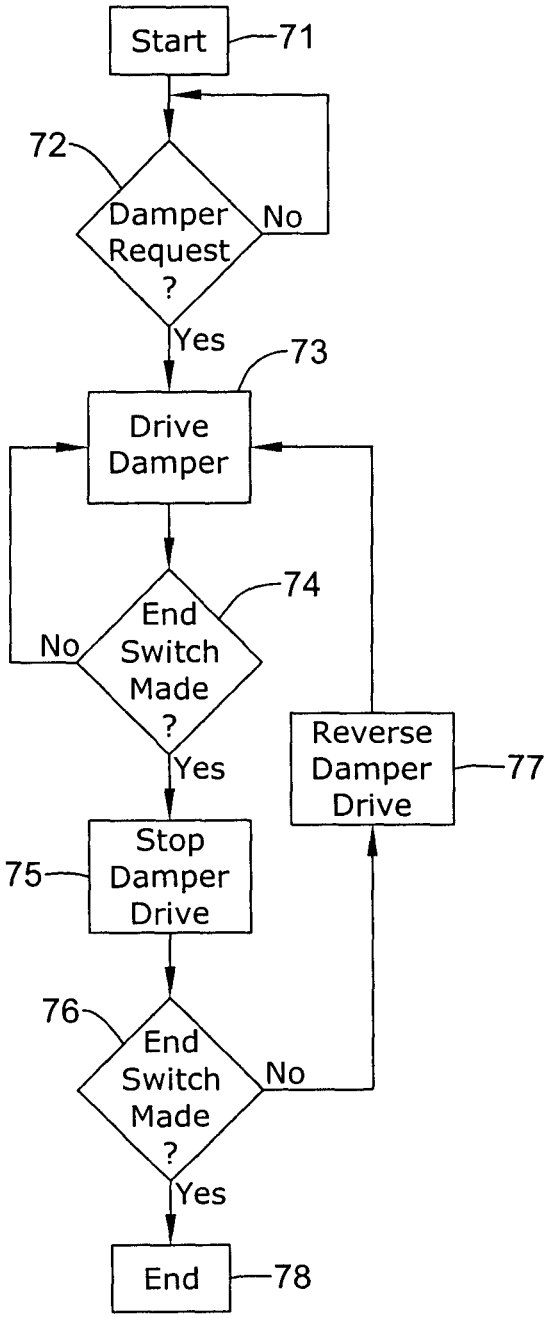
FIG. 5 is a flow diagram of an operation of a damper control system.

FIG. 5 is a flow diagram of an operation of a damper control system 10. The operation may begin at start 71 which leads to a symbol 72 where a question of whether there is a damper request. If not, then a return to the beginning of symbol 72 may occur. If the answer is yes, then a drive damper may occur at block 73 and the operation continue onto symbol 74 where a question of whether an end switch was made. The end switch may be activated by a cam connected to the damper. The making of the end switch may indicate an opening of the damper. If the question to symbol 74 is no, the there is a return to the drive damper block 73. The question of symbol 74 may be again answered. When a yes occurs, then the damper is stopped at block 75. Then at symbol 76, a question of whether an end switch was made is asked. If the answer to the question is no, it may mean that the end switch on the cam connected to damper was overshot. Then the damper drive may be reversed at block 77. The approach from block 73 through symbol 76 may repeated. When an answer to the question in symbol 76 is yes, then the operation may stop at the end block 78.

Figure 6:
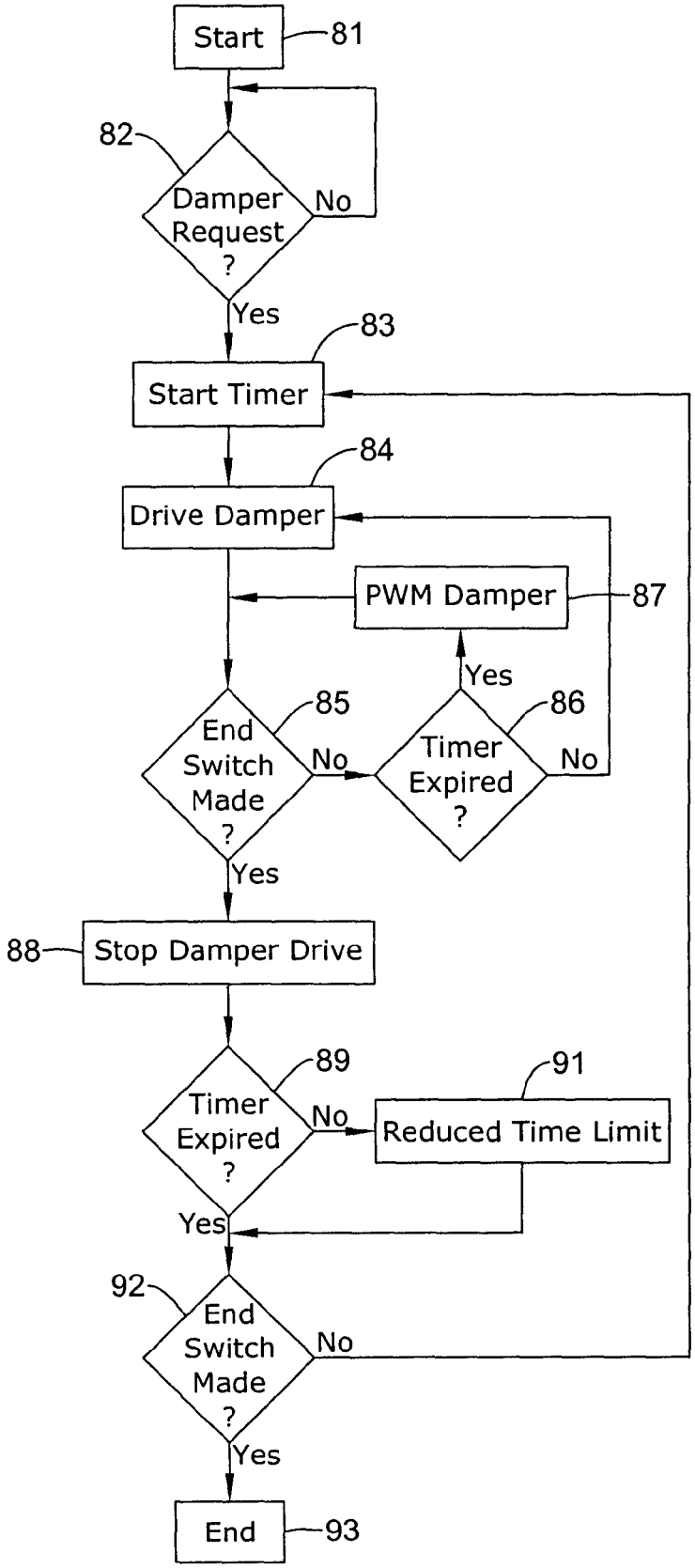
FIG. 6 is a flow diagram of a more detailed operation of a damper control system.

FIG. 6 is a flow diagram of a more detailed operation of a damper control system 10 which may begin at a start block 81 and proceed to a symbol 82 where a question concerning a damper request is asked. If an answer is no, then a return to the entry of symbol 82 may be made. When the answer is yes to the question in symbol 82, then the operation may proceed to a block 83 where a timer is started and the damper is driven at block 84. At symbol 85, a question of whether an end switch was made may be asked. If an answer is no, then another question asking whether the timer was expired may be asked at symbol 86. If an answer to the question in symbol 86 is no, then the operation may return to the drive damper block 84. If the answer is yes to the question in symbol 86, then the operation may go to a PWM damper block 87 after which the operation goes to the question asked in symbol 85. If the answer to the question in symbol 85 is yes, then the operation may proceed to stop the damper drive at block 88. After stopping the damper drive, then at symbol 89, a question whether the timer was expired may be asked. If an answer is no, then the time limit may be reduced at block 91 because the damper reached the end switch position before the PWM began. Reducing the time limit will cause the PWM to start sooner on the next cycle. If the answer is yes, then the operation may go to symbol 92 for a question of whether an end switch is still made. If an answer is no, then the operation may return to block 83 where the damper driving procedure is started again. In this case, it is assumed the damper spun past the end switch. Since the damper in this example moves in one direction only, the damper must be driven completely around again. If an answer to the question in symbol 92 is yes, then the operation may end at block 93.

Figure 7:
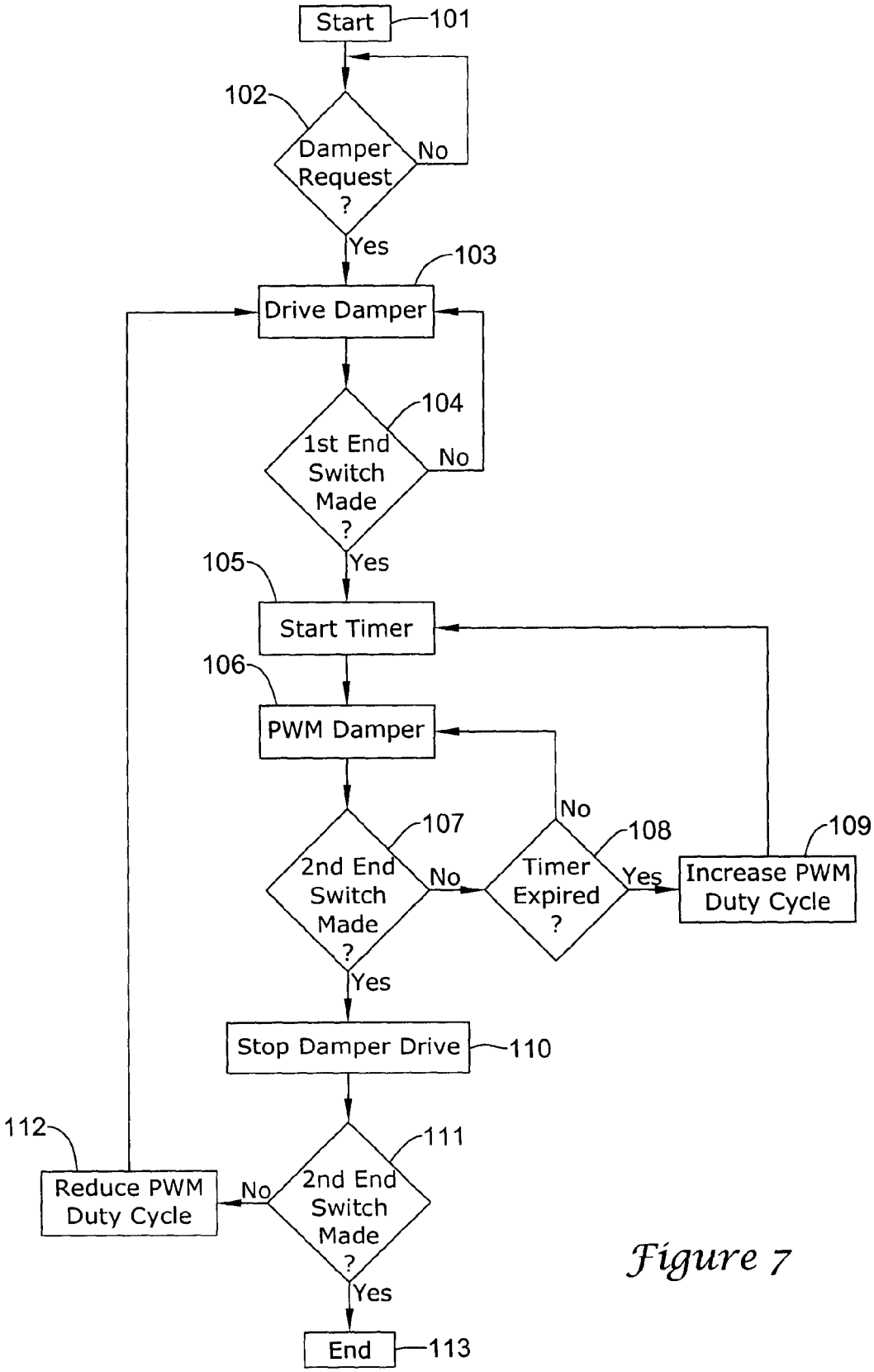
FIG. 7 is a flow diagram of another detailed operation of a damper control system.

FIG. 7 is a flow diagram of another detailed operation of a damper control system 10 which may begin at start block 101 and proceed to a symbol 102 where a question about a damper request is asked. If there is not a damper request, then a return to the entry of symbol 102 may be made. If the answer is yes to the question in symbol 102, then the operation may proceed to a block 103 where a damper is driven. The operation may proceed further on to a symbol 104 where a question of whether a first end switch was made or not. If an answer is no, then the operation may return to block 103 to drive the damper. If the answer is yes, then the operation may start a timer at block 105. Then the operation may proceed to provide PWM to the damper drive at block 106. From block 106, the operation may proceed to symbol 107 which asks the question whether the second end switch was made. If an answer is no, then operation may proceed to symbol 108 to ask a question whether the timer had expired. If an answer is no, then the operation may proceed to block 106 to continue to provide PWM to the damper drive. If the answer is yes to the question in symbol 108, then the operation may proceed to block 109 to increase a PWM duty cycle and then go to block 105 to start the timer. The timer may track the expected time it takes to slow the damper down and coast to the end switch position. When the timer expires, it is assumed the damper is moving too slowly or even has stopped. The PWM may be increased to speed up the damper slightly so it reaches the end switch sooner. If the answer to the question at symbol 107 is yes, then the operation may proceed to stop the damper drive at block 110 and go to a symbol 111 where a question whether the second end switch was made. If an answer to the question is no, then the PWM duty cycle may be reduced at block 112 and the operation may return to block 103 to restart the damper drive procedure. If the answer to the question in symbol 111 is yes, then the operation may end at block 113.

In the present specification, some of the matter may be of a hypothetical or prophetic nature although stated in another manner or tense.

Although the invention has been described with respect to at least one illustrative example, many variations and modifications will become apparent to those skilled in the art upon reading the present specification. It is therefore the intention that the appended claims be interpreted as broadly as possible in view of the prior art to include all such variations and modifications.

What is claimed is:

1. A damper control system for a fuel burning appliance, comprising:

a power source;

a power management component connected to the power source;

an energy storage component connected to the power management component;

a damper control component connected to the energy storage component; and a controller connected to the power management component and the damper control component; and wherein:

the power source comprises a heat-to-electric power converter or a light-to-electric power converter; and the energy storage component is for storing electric energy from the power source.

2. The system of claim 1, a source of heat or light for the power source comprises one or more items comprising a pilot light for igniting a flame, a flame, ambient light or a bulb.

3. The system of claim 1, wherein:

the energy storage component comprises one or more items comprising a capacitor or a battery; and the energy storage component is capable of storing electric energy sufficient to operate a damper assembly.

4. The system of claim 1, wherein:

the controller is for providing a control signal to the damper control component, based on inputs comprising energy storage component status, a damper position signal, or an appliance need for heat; and the damper control component is for outputting a damper drive signal in accordance with the control signal.

5. The system of claim 4, wherein the damper control component is connected to a damper assembly.

6. The system of claim 5, wherein the damper assembly comprises one or more damper position detectors for providing the damper position signal.

7. The system of claim 5, wherein the damper assembly comprises:

an electrical mover connected to the damper control component;

a damper connected to the electrical mover; and a position indicating mechanism proximate to the damper; and wherein the position indicating mechanism is for indicating one or more damper positions and for providing a damper position signal indicative of the one or more damper positions as an input to the controller.

8. The system of claim 7, wherein the controller is for controlling power via the damper control component as a damper drive signal to the electrical mover to control a position of the damper.

9. The system of claim 8, wherein the damper drive signal has a polarity which is reversible by the damper control component as directed by the controller in accordance with damper position signals from the position indicating mechanism.

10. The system of claim 7, wherein:

the energy storage component is for further providing power to the damper control component;

a pulse width modulation component of the control signal is generated by the controller in accordance with a damper position signal from the position indicating mechanism; and the pulse width modulation component has a duty cycle which is adjustable.

11. The system of claim 10, wherein:

the pulse width modulation component is further generated by the controller more in accordance with a signal from the energy storage component;

the damper control component is for outputting a damper drive signal to the electric mover; and the damper drive signal comprises the pulse width modulation component.

12. The system of claim 11, wherein the pulse width modulation component is adjusted as the damper approaches a destination position.

13. The system of claim 4, wherein:

the control signal comprises a pulse width modulated component as needed; and the pulse width modulation component has a duty cycle which is adjustable.

14. The system of claim 1, wherein:

the heat-to-electric power converter comprises one or more thermopiles; and the light-to-electric power converter comprises one or more solar cells.

15. The system of claim 1, wherein the power management component is for managing electric power going from the power source to the energy storage component.

16. A damper control device comprising:

a power converter;

an electric energy storage component for receiving power from the power converter;

a damper control component for controlling a flow through a flue of a fuel burning appliance; and a power management component for controlling the power from the power converter to the electric energy storage component and for controlling power from electric energy storage component or the power converter to the damper control component.

17. The device of claim 16, wherein the fuel burning appliance is a water heater.

18. The device of claim 16, wherein the energy storage component is capable of storing electric energy sufficient to operate the damper control component.

19. The device of claim 18, wherein:

the damper control component controls the flow through the flue with drive signals to a damper assembly; and the damper assembly comprises:

a damper;

a electrical mover connected to the damper; and a sensor for indicating a position of the damper.

20. The device of claim 19, wherein:

controlling a damper comprises:

a request to the damper control component to move the damper to a particular position; and the damper control component providing drive signals to the damper assembly to move the damper;

if the damper has not approached the particular position according to the sensor, then the damper control component continues to provide drive signals to the damper assembly;

if the damper has approached the particular position according to the sensor, then the damper control component provides cease signals to stop movement of the damper; and if the damper goes beyond the particular position according to the sensor, then the damper control component provides reverse drive signals to move the damper in an opposite direction or provides drive signals to move the damper in the same direction to approach the particular position.

21. A control system for a damper comprising:

a power converter;

a power management component connected to the power converter;

an energy storage component connected to the power management component;

a damper control component connected to the energy storage component; and a controller connected to the power management component and the damper control component; and wherein:

the energy storage component comprises one or more items comprising a capacitor or a battery;

the power converter provides electrical power converted from heat or light to charge the energy storage component; and the energy storage component has sufficient capacity to store energy to operate a damper assembly.

22. The system of claim 21, wherein:

the damper control component is for providing a control signal to the damper assembly to control a position of a damper of the assembly;

a pulse width modulation component of the control signal is generated by the controller for the damper control component in accordance with a damper position signal from a position indicating mechanism proximate to a damper; and the pulse width modulation component has a duty cycle which is adjustable.

23. The system of claim 21, wherein a source of heat or light for the power converter comprises one or more items comprising a pilot light for igniting a flame, a flame, ambient light or a bulb.

* * * * *